US006860797B1

(12) United States Patent
Chuang

(10) Patent No.: US 6,860,797 B1
(45) Date of Patent: Mar. 1, 2005

(54) RECIPROCATING DEVICE FOR A POLISHING ROLLER OF AN EMERY-POLISHING MACHINE

(76) Inventor: Bor Yann Chuang, No. 78, Yungfeng Rd., Taiping Shiang, Taichung (TW), 411

( * ) Notice: Subject to any disclaimer, the term of this patent is extended or adjusted under 35 U.S.C. 154(b) by 0 days.

(21) Appl. No.: 10/697,110

(22) Filed: Oct. 31, 2003

(51) Int. Cl.[7] ..... B24B 7/00
(52) U.S. Cl. ..... 451/155; 451/157
(58) Field of Search ..... 451/162, 155, 451/150, 157, 167, 119, 120, 121, 124, 129

(56) References Cited

U.S. PATENT DOCUMENTS 2,989,823 A * 6/1961 Bernstein ..... 451/121
6,342,000 B1 * 1/2002 Yan ..... 451/304
6,685,545 B2 * 2/2004 Chuang ..... 451/155

* cited by examiner

*Primary Examiner*—Dung Van Nguyen
(74) *Attorney, Agent, or Firm*—Troxell Law Office, PLLC

(57) ABSTRACT

A reciprocating device for a polishing roller of an emery-polishing machine includes a connect device pivotally connected with a bearing base for a support shaft of a polishing roller to fit in, a belt wheel fixed on the connect device to rotate the support shaft together with the polishing roller, and a reciprocating device having a belt wheel, a worm engaging a worm wheel to rotate a rotating shaft to move an eccentric member fixed on the upper end of the rotating shaft. Then the eccentric member rotates eccentrically to move back and forth to move a shaft sleeve of the support shaft of the polishing roller so that the polishing roller may also move sidewise back and forth in addition to its rotation to upgrade polishing effect against wooden works.

5 Claims, 4 Drawing Sheets

RECIPROCATING DEVICE FOR A POLISHING ROLLER OF AN EMERY-POLISHING MACHINE

BACKGROUND OF THE INVENTION

1. Filed of the Invention

This invention relates to an emery-polishing machine, particularly to one provided with a reciprocating device for a polishing roller of an emery-polishing machine so as to upgrade polishing results against wooden works.

2. Description of Prior Arts

A conventional emery-polishing machine generally has a motor for rotating a polishing roller for carrying out sand polishing process, and the polishing roller always rotates only in one direction, hardly capable to make a wooden work completely glossy and smooth. Moreover, should there be any projection on the surface of the work, the polishing roller might be broken owing to its single direction of rotating. In addition, if a user did not notice the disorder, the work might be polished unbalanced at the location of the projection, resulting in an unqualified work. The inventor of this application also filed an application of U.S. patent case of the filing No. 10/001821 titled "Reciprocating Device for a Polishing Roller of an Emery Polishing Machine" to improve the above-mentions flaw, but it still has a complicated structure, not ideal.

SUMMARY OF THE INVENTION

The Purpose of the invention is to offer a reciprocating device for a polishing roller of an emery-polishing machine, which has a function of rotating the polishing roller and another function of reciprocating movement of the polishing roller as well. Then it can upgrade the polishing effect of a wooden work.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
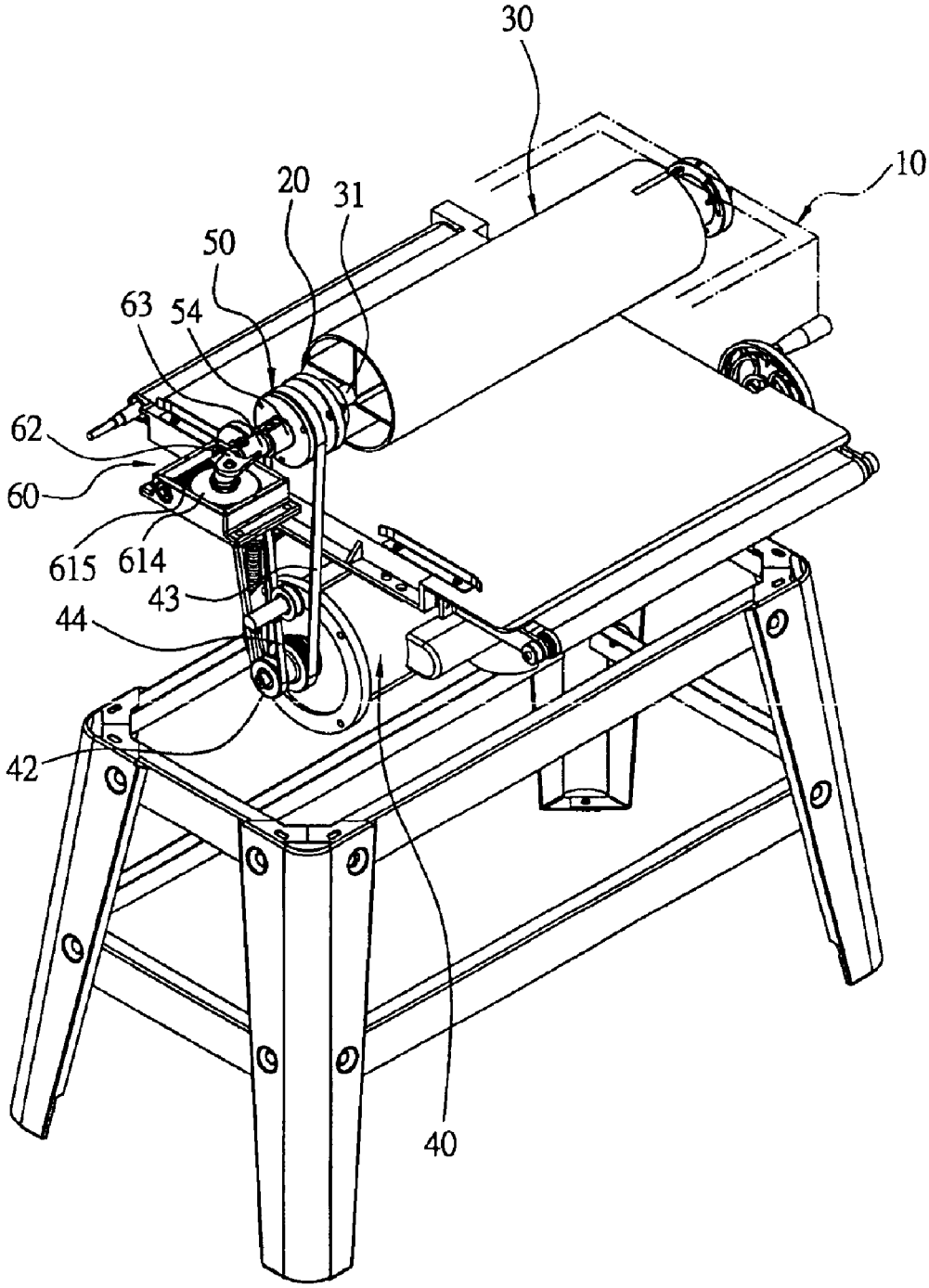
FIG. 1 is a partial perspective view of an emery-polishing machine provided with a reciprocating device for a polishing roller in the present invention.
Figure 2:
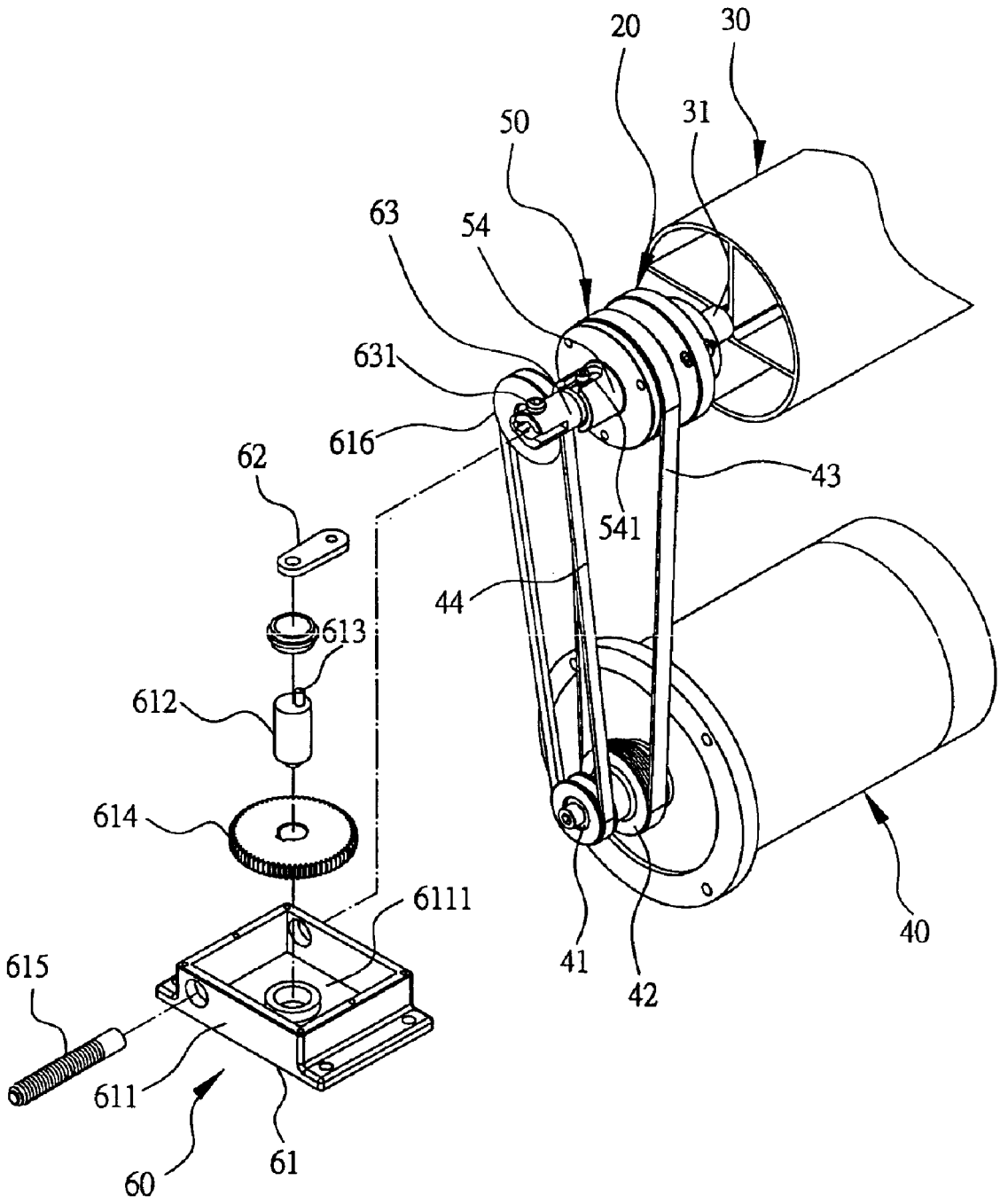
FIG. 2 is a partial cross-sectional view of the reciprocating device for a polishing roller of an emery-polishing machine in the present invention.
Figure 3:
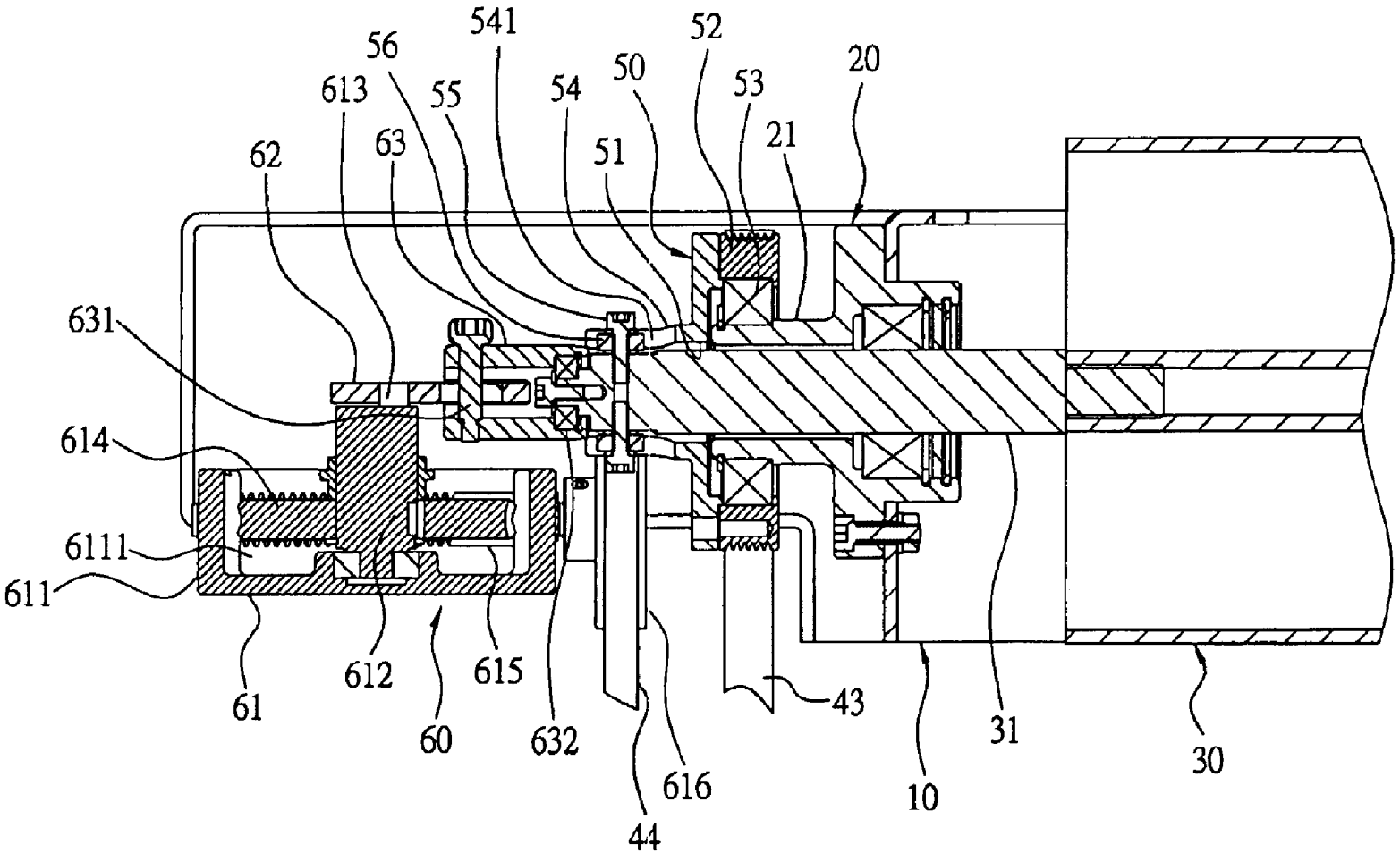
FIG. 3 is a partial front cross-sectional view of the reciprocating device for a polishing roller of an emery-polishing machine in the present invention.

A preferred embodiment of a reciprocating device for an polishing roller of an emery-polishing machine in the present invention, as shown in FIGS. 1, 2 and 3, includes a connect device 50 and a reciprocating device 60 combined with a machine base 10, a bearing base 20 respectively provided at two opposite sides of the machine, base 10, a polishing roller 30, two supporting shafts 31 of the polishing roller 30 connected with the bearing bases 20, a motor 40 for rotating the polishing coo roller 30.

The motor 40 has an output spindle 41, a belt wheel 42 fixed on the output spindle 41, and an endless belt 43 extending around the belt wheel 42 and the connect device 50 for rotating one support shaft 31 of the polishing roller 30, and another endless belt 44 extending around another belt wheel 42' fixed on the spindle 41 and a belt wheel 616 of the reciprocating device 60.

The connect device 50 has a center shaft hole 51 for the left supporting shaft 31 of the polishing roller 30 to fit therein, and a belt wheel 52 fixed on an inner section of the connect device 50 by means of a bearing 53 and rotated by a belt 43, and the bearing 53 pivotally fitting around a tubular portion 21 of the bearing base 20 so that the connect device 50 may be pivotally connected on an outer end of the bearing base 20. Further, the connect device 50 has a tubular portion 54 extending outward, and a lateral guiding groove 541 with a preset depth respectively provided in two opposite sides on the outer portion. Then a guide pin 55 is inserted in each guide groove 541 and also firmly in the supporting shaft 31, and further a slide wheel 56 is fixed around the guide pin 55, with the peripheral surface of the slide wheel 56 contacting two walls of the guiding groove 541. Then the slide wheel 56 can slide in a limited distance laterally. In addition, the connect device 50 can rotate together with the left support shaft 31 of polishing roller 30, driven by the belt wheel 52, which is rotated by the belt 43.

The reciprocating device 60 includes a gear box 61, a swaying member 62, and a shaft sleeve 63. The gear box 61 is fixed on a proper location of the machine base above the motor 40, having a U-shaped body 611 defining an inner chamber 6111 with an upper opening, a rotating shaft 612 positioned upright in the center portion of the chamber 6111, an eccentric post 613 extending up eccentrically on an upper surface of the rotating shaft 612, a worm gear 614 fixed around a lower portion of the transmitting shaft 612, a worm fixed laterally in an upper portion of the chamber 6111 and engaging the worm gear 614, a belt wheel 616 fixed with an inner end of the worm 615, and a belt 44 for reciprocating of the polishing roller extending around the belt wheel 616 to rotate the same wheel 616. The swaying member 62 is oblong, having its outer end portion pivotally connected with the eccentric post 613, and the shaft sleeve 63 has its outer end pivotally connected with the inner end portion of the swaying member 62 by a bolt 631 and its inner end pivotally connected with an outer end of the left support shaft 31 of the polishing roller 30 by means of a bearing 632.

Figure 4:
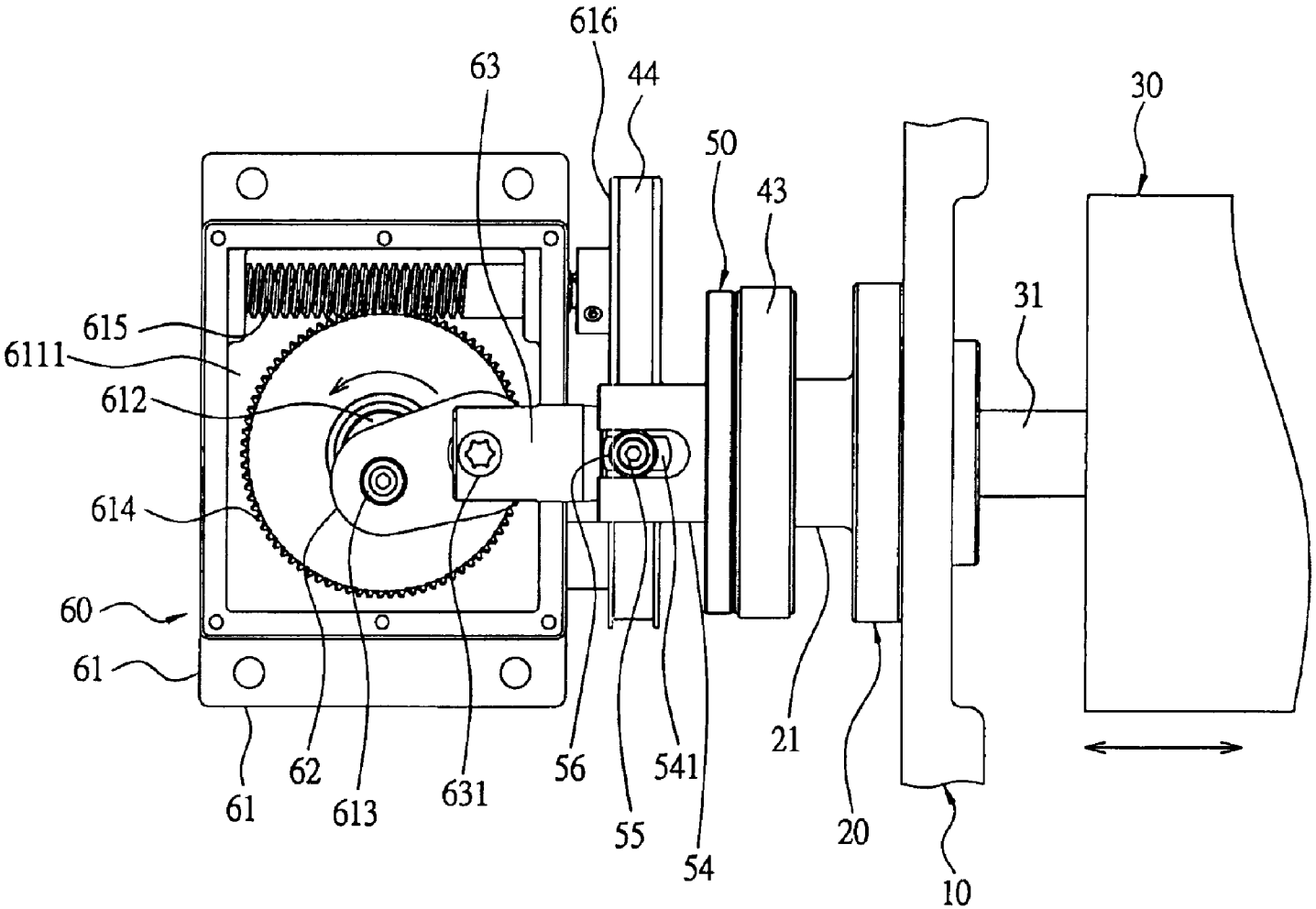
FIG. 4 is an upper view of reciprocating movement of the polishing roller in the present invention.

Next, the actions and functions of the components are to be described. As shown in FIGS. 2 and 4, the polishing roller 30 not only rotates but also reciprocates sidewise back and forth for a preset distance, driven by the motor 40. The motor 40 starts to rotate the belt wheel 42 to move the belt 43, which then rotates the belt wheel 52 of the connect device 50. Then the whole connect device 50 rotates the left support shaft 31 of the polishing roller 30 by the structure of the mutual connection of the connect device 50 with the left support shaft 31 and limitation of the guide pin 55 fixed with the support shaft 31 against the slide wheel 56. As for the reciprocation of the polishing roller 30, it is effected by the reciprocating belt 44 fixed on the belt wheel 42. As the belt 44 drives the belt wheel 616 of the reciprocating device 60, with the belt wheel 616 rotating the worm 615, with the worm 615 rotating the worm gear 614. Then the rotating shaft 612 rotates together with the worm gear 614, with the eccentric post 61 rotated eccentrically to force the swaying member 62 to sway back and forth, and with the shaft sleeve 63, the support shaft 31 and then the polishing roller 30 all moving back and forth, or reciprocating in a preset distance defined by the swaying distance of the swaying member 62.

Furthermore, the motor 40 offers the force for both the rotation and the reciprocation of the polishing roller 30, so the equipment cost for the power source is effectively diminished. Besides, the different structures are used for rotation and for reciprocation of the polishing roller 30, so there can be no interference between the two different actions of the polishing roller 30, favorable for operation of the machine and the maintenance and repair of the components as well.

In general, the polishing roller 30 in the invention can rotate and reciprocate sidewise back and forth synchronously, performing polishing processes in two ways, obtaining better results for polishing wooden works. Moreover, should the sand band on the polishing roller have any flaw, the two actions, rotation and sidewise reciprocation of the polishing roller can compensate would-be drawbacks of the sand band, not emphasizing the same spot continuously polished.

While the preferred embodiment of the invention has been described above, it will be recognized and understood that various modifications may be made therein and the appended claims are intended to cover all such modifications that may fall within the spirit and scope of the invention.

What is claimed is:

1. A reciprocating device assembly for a polishing roller of an emery-polishing machine including a machine base, a machine body, a bearing base respectively provided on opposite sides of said machine base, a polishing roller having a support shaft at two ends respectively connected with said bearing bases, said polishing roller driven by a motor fixed on said machine base for carrying out a polishing process, said reciprocating device assembly comprising:

a connect device positioned on said machine base and having a belt wheel provided with a shaft rotated by a spindle of said motor, said shaft movable laterally back and forth for a preset distance; and, a reciprocating device positioned on the machine body and including a rotating shaft, a swaying member fixed eccentrically on an upper surface of said rotating shaft so as to interact with said shaft of said connect device for reciprocating said polishing roller sidewise.

2. The reciprocating device assembly for a polishing roller of an emery polishing machine as claimed in claim 1, wherein said connect device further comprises a belt wheel fixed on an inner wall by a bearing, said bearing pivotally fitting around an outer end of the bearing base, and an endless belt extending around said belt wheel and the spindle of said motor.

3. The reciprocating device assembly for a polishing roller of an emery-polishing machine as claimed in claim 1, wherein said connect device further comprises a tubular portion formed in an outer end portion, said tubular portion provided with a guide groove with a preset depth respectively in opposite sides of an outer end, a guide pin inserted in each of said guiding grooves and also into said shaft, a slide wheel fixed on each of said guide pins, with said slide wheel having a periphery in a contact with two sidewalls of said lateral guide groove of said connected device to limit lateral movement of said connect device.

4. The reciprocating device assembly for a polishing roller of an emery-polishing machine as claimed in claim 1, wherein said reciprocating device further comprises: a gear box and a rotating shaft, said gear box having a U-shaped body, said U-shaped body having an inner chamber with an upper opening, said rotating shaft is positioned upright in a center portion of said inner chamber, an eccentric post extends up eccentrically on an upper surface of said rotating post, said swaying member having an outer end portion pivotally connected with said eccentric post; a worm gear fixed around a lower portion of said rotating shaft and engaging a worm laterally provided in an upper portion of said inner chamber; a belt wheel fixed with an inner end portion of said worm, and an endless belt extending around said belt, wheel and said motor for rotating said belt wheel for reciprocating said polishing roller.

5. The reciprocating device assembly for a polishing roller of an emery polishing machine as claimed in claim 1, wherein said reciprocating device further comprises a shaft sleeve having an outer end pivotally connected with an inner end of said swaying member by a bolt, and an inner end pivotally connected with said left support shaft of said polishing roller by a bearing.

* * * * *